US012644451B2

(12) United States Patent
Hembree

(10) Patent No.: US 12,644,451 B2
(45) Date of Patent: Jun. 2, 2026

(54) BALANCED PRESSURE SEAL FOR HIGH PRESSURE PUMPS

(71) Applicant: Wanner Engineering, Inc., Minneapolis, MN (US)

(72) Inventor: Richard D. Hembree, Port Coquitlam (CA)

(73) Assignee: WANNER ENGINEERING, INC., Minneapolis, MN (US)

( * ) Notice: Subject to any disclaimer, the term of this patent is extended or adjusted under 35 U.S.C. 154(b) by 0 days.

(21) Appl. No.: 18/904,998

(22) Filed: Oct. 2, 2024

(65) Prior Publication Data

US 2025/0116270 A1 Apr. 10, 2025

Related U.S. Application Data

(60) Provisional application No. 63/588,226, filed on Oct. 5, 2023.

(51) Int. Cl.
*F04B 53/10* (2006.01)
*F04B 53/14* (2006.01)

(52) U.S. Cl.
CPC ..... *F04B 53/106* (2013.01); *F04B 53/143* (2013.01)

(58) Field of Classification Search
CPC ..... F04B 53/10; F04B 53/106; F04B 53/143
See application file for complete search history.

(56) References Cited

U.S. PATENT DOCUMENTS 3,112,757 A 12/1963 Wanner
3,157,198 A 11/1964 Wanner
3,174,436 A 3/1965 Wanner
3,216,355 A 11/1965 Wanner
3,244,195 A 4/1966 Wanner
4,659,294 A * 4/1987 Barthomeuf ..... F03C 1/0073 91/320

(Continued)

FOREIGN PATENT DOCUMENTS

CN 2248255 Y * 2/1997
CN 108757367 A * 11/2018 ..... F04B 53/166

(Continued)

OTHER PUBLICATIONS

International Search Report and Written Opinion for PCT/US2024/049672 mailed Dec. 12, 2024, 33 Pages.

*Primary Examiner* — Thomas E Lazo
(74) *Attorney, Agent, or Firm* — Merchant & Gould, P.C.

(57) ABSTRACT

A pump includes a cylindrical plunger chamber having an inward projecting radial seal. A plunger moves with a reciprocating stroke within the cylindrical plunger chamber, the plunger having a first diameter, and a second diameter less than the first diameter, the radial seal engaging the plunger at the second diameter for an entire length of the stroke of the plunger. A pressure balancing valve is in fluid communication with the pumping chamber and the hydraulic oil chamber. A fluid passage connects to the plunger chamber at a position between the radial seal and the first diameter of the plunger and leads to the pressure balancing valve. A radial clearance is between the cylinder and the second diameter, and a seal between the first portion and the cylinder having a clearance smaller than the radial clearance allows hydraulic fluid to escape past the seal during a plunger stroke.

12 Claims, 8 Drawing Sheets

(56) References Cited

U.S. PATENT DOCUMENTS

| | | | | |
|---|---|---|---|---|
| 7,425,120 | B2 | 9/2008 | Hembree | |
| 9,964,106 | B2 | 5/2018 | Hembree | |
| 10,920,763 | B2 | 2/2021 | Poindexter et al. | |
| 11,015,595 | B2 | 5/2021 | Wu et al. | |
| 11,448,205 | B2 | 9/2022 | Meinz et al. | |
| 2008/0273997 | A1* | 11/2008 | Hembree | F04B 43/067 417/375 |
| 2015/0118078 | A1* | 4/2015 | Hembree | F04B 43/067 417/393 |
| 2015/0118082 | A1 | 4/2015 | Hembree | |
| 2016/0123319 | A1 | 5/2016 | Hembree | |
| 2019/0055939 | A1 | 2/2019 | Buckley | |
| 2022/0397107 | A1* | 12/2022 | Thomas | F04B 53/16 |

FOREIGN PATENT DOCUMENTS

| | | | |
|---|---|---|---|
| CN | 110966175 | A | 4/2020 |
| GB | 1015266 | A | 12/1965 |

* cited by examiner

100

BALANCED PRESSURE SEAL FOR HIGH PRESSURE PUMPS

CROSS-REFERENCE TO RELATED APPLICATION(S)

This application claims the benefit of U.S. Provisional Application No. 63/588,226, filed Oct. 5, 2023, the complete disclosure of which is hereby incorporated herein by reference in its entirety.

BACKGROUND OF THE INVENTION

Field of the Invention

The present invention relates to a sealing system for high pressure pumps that balances pressure across a seal and avoids problems with wear.

Description of the Prior Art

Conventional positive displacement pumps that are used to pump high pressure liquids typically use reciprocating plungers with a packing to seal the pumped fluid. At high pressure, sometimes higher than 10,000 psi, these packings are pressure energized and press against the moving plunger with extremely high force. This force generates high friction resulting in heat production and rapid wear, which may lead to failure. This condition is made worse when the fluid contains abrasive solid particles. In these high pressure, abrasive fluid applications the plungers, packings and packing boxes experience wear and can wash out, resulting in the need for costly, frequent maintenance. To minimize this problem, pressurized lubricant is fed into the stuffing box to both cool and lubricate the packings. While lubrication helps, lubrication alone does not eliminate the problem.

One approach to try and avoid this problem is with a plunger pump with a plunger that displaces only oil, which moves a diaphragm or piston that in turn displaces the abrasive slurry. The plunger can be sealed against the high pressure by a close clearance to the cylinder so that the viscosity of the oil is sufficient to maintain pressure without a seal. U.S. Pat. No. 7,425,120 describes a pump in which a valve system maintains the oil that displaces the diaphragm so that a diaphragm has only a small pressure differential across it. However, this type of pump becomes less viable in very high-pressure applications of large pumps because of the size of the diaphragm and the large chamber diameters that must contain the high pressure.

Balancing pressure across the seal is challenging for such an arrangement as the pressure changes drastically between the pressure stroke and the suction. Moreover, such a sealing arrangement must prevent the abrasive fluid from wearing seals.

It is therefore appreciated that there exists a need for a new and improved sealing system for high pressure positive displacement pumps. Such a system should balance the pressure across the seal or packing on both the pressure and suction stroke so that the seal is never pressure energized and therefore never exerts a high force on the plunger. Moreover, the seal of such system should always have a small bias pressure of oil to keep the abrasive fluid from wearing the seal. The present invention address these problems and others associated with seals for high pressure pumps.

SUMMARY OF THE INVENTION

The present invention is directed to a positive displacement pump, such as a plunger pump. For multi-cylinder pumps, the pump is driven by connection to a rotating crankshaft mounted in a crankcase. The pump may include multiple plunger assemblies and associated components connected to the crankshaft. A manifold houses one or more check valves with inlet/outlet valves associated with each plunger assembly.

The plunger has a first portion with a first diameter (D1) that is made to fit with a close clearance (C) to the sleeve. The clearance (C) is sized to be sufficiently small that high pressure oil will only pass very slowly through the clearance (C). Typically, the clearance is about 0.001 inch measured radially. The plunger has a second portion with a second diameter (D2) that is slightly smaller than the first. A low pressure seal is positioned so that the low pressure seal contacts the second diameter (D2) for the full stroke of the plunger.

A fluid passage connects with the annular space (A) between the first diameter (D1) of the plunger, and the seal. Since the plunger reciprocates, the annular space (A) changes in length during the stroke, causing a small displacement of the oil in that space. The volume of the displacement is defined by the area formed by the difference in diameter (D1) and diameter (D2) multiplied by the stroke of the plunger:

$$V = \pi L\left((D1/2)^2 - (D2/2)^2\right)$$

Where: V is the volume
D1 is the outer diameter
D2 is the inner diameter
L is the length of the plunger stroke The diameters (D1, D2) are configured so that the oil displacement is slightly more than the maximum expected volume of oil that leaks past the clearance (C) during the pressure stroke of the pump.

In one embodiment, the plunger extends into the main pumping chamber. During the suction stroke the plunger draws the pumped fluid, such as water, into chamber through an inlet check valve. During the pressure stroke the plunger moves forward and displaces fluid out of chamber through the discharge check valve. A pressure balancing valve is connected to annular space (A) by the fluid passage. The valve is also connected to the pumping chamber by a passage.

In one embodiment, the pressure-balancing valve includes a diaphragm connected to a valve spool. The spool slides in a bore that is connected to an oil chamber at least partially formed by the back side of the diaphragm. The oil chamber is filled with oil and is connected to both sides of the spool by a passage within the spool. In another embodiment, the pressure-balancing valve includes a piston assembly connected to a plunger. In a further embodiment, the pressure-balancing valve includes a plunger with a complementary seal instead of a diaphragm or piston.

The spool is positioned to cover and uncover two ports of the pressure balancing valve. The pressure balancing valve includes an outlet port connected to a pressure balancing outlet check valve that allows oil to leave the oil chamber and flow into the oil sump. The pressure balancing valve includes an inlet port connected to a pressure balancing inlet check valve that allows oil to flow from the sump into the oil chamber.

A spring is positioned to apply a biasing force on the spool, which in turn pulls on the diaphragm. The front of the diaphragm faces a front chamber that is connected to the pumping chamber by the passage. The pumping chamber, the front chamber and the connecting passage are always filled with the fluid being pumped, such as water.

According to one embodiment of the invention, high pressure seal rings are used that also provide a close fit. The high pressure seal rings may be necessary in larger, high pressure pumps where the amount of oil that leaks past the close fit of the plunger is too great. In such applications, metal piston rings can be used as the sealing element. The metal piston rings achieve much higher life than an elastomeric seal, while also maintaining a small leak rate. Moreover, since the high pressure seal rings are sealing only oil, the high pressure seal rings do not suffer the same wear that a conventional packing would. However, it is appreciated that this type of seal may not be viable for sealing pumped fluid like water in a conventional plunger pump.

In operation, as the plunger reciprocates, pumping chamber cycles between high pressure during the pressure stroke, and low pressure during the suction stroke. Since the diaphragm is able to move, the pressure of the oil in chamber also cycles between suction and discharge pressure.

The function of the pressure balancing valve is to maintain a volume of oil behind the diaphragm so that the diaphragm is always free to move and keep the oil pressure the same as the pumped fluid pressure. An objective of the present invention is to maintain oil pressure on the back side of the seal that is very close to the pressure in the pumping chamber. In this way, the seal is not pressure energized and is not subject to high friction loads.

It is also beneficial to have the oil pressure always slightly higher than the pumped fluid pressure. A pressure differential of about 5 psi has the benefit of always having the hydraulic oil slip past the seal rather than the pumped fluid. In one example, during the suction stroke when the plunger is retracting, the fluid pressure might be 10 psi, so the oil pressure would be 15 psi. On the pressure stroke, the fluid pressure might rise to 10,000 psi, so the oil pressure would be 10,005 psi. Therefore, as the plunger moves forward, a very small amount of oil is helped to escape past the valve by that slight pressure differential, thereby preventing the pumped fluid from ever getting past the seal. It has been found that the differential pressure can be in the range of about 1 to 10 psi with similar benefits.

This small pressure differential is achieved by the force applied to the diaphragm by a spring. The spring is sized so the force when in the center position would be equal to the force exerted by the diaphragm, with a 5 psi differential across the diaphragm. During each pressure stroke a small amount of oil leaks through the plunger clearance (C). Another advantage of the present invention is the ability of the valve to replenish the oil in the oil chamber as needed.

The length of the spool allows the spool to cover the pressure balancing outlet port and the pressure balancing inlet port when the diaphragm is in the center position. As oil is lost from the oil chamber, the diaphragm moves back, and the spool will start to uncover the pressure balancing inlet port. During the suction stroke the pressure in the oil chamber drops and oil is drawn in through the pressure balancing inlet check valve. In the case where the pump is pressure fed, the oil may not drop in pressure sufficient to draw in oil, so the diaphragm will continue to move back until the diaphragm reaches its end of travel. At this point the small displacement in space (A) will draw oil in, dropping the pressure as needed to draw from the oil sump. If too much oil is drawn in, the diaphragm will move forward, which closes the pressure balancing inlet port and opens the pressure balancing outlet port. During the next pressure stroke, oil will discharge from the oil chamber via the pressure balancing outlet check valve. As the pump runs in steady state conditions, the pressure balancing valve will reach an equilibrium position where pressure balancing inlet port is open just the amount needed to add oil to match the demand.

These features of novelty and various other advantages that characterize the invention are pointed out with particularity in the claims annexed hereto and forming a part hereof. However, for a better understanding of the invention, its advantages, and the objects obtained by its use, reference should be made to the drawings that form a further part hereof, and to the accompanying descriptive matter, in which there is illustrated and described a preferred embodiment of the invention.

BRIEF DESCRIPTION OF THE DRAWINGS

Referring now to the drawings wherein like reference letters and numerals indicate corresponding structure throughout the several views.

DETAILED DESCRIPTION OF THE PREFERRED EMBODIMENT

Figure 1:
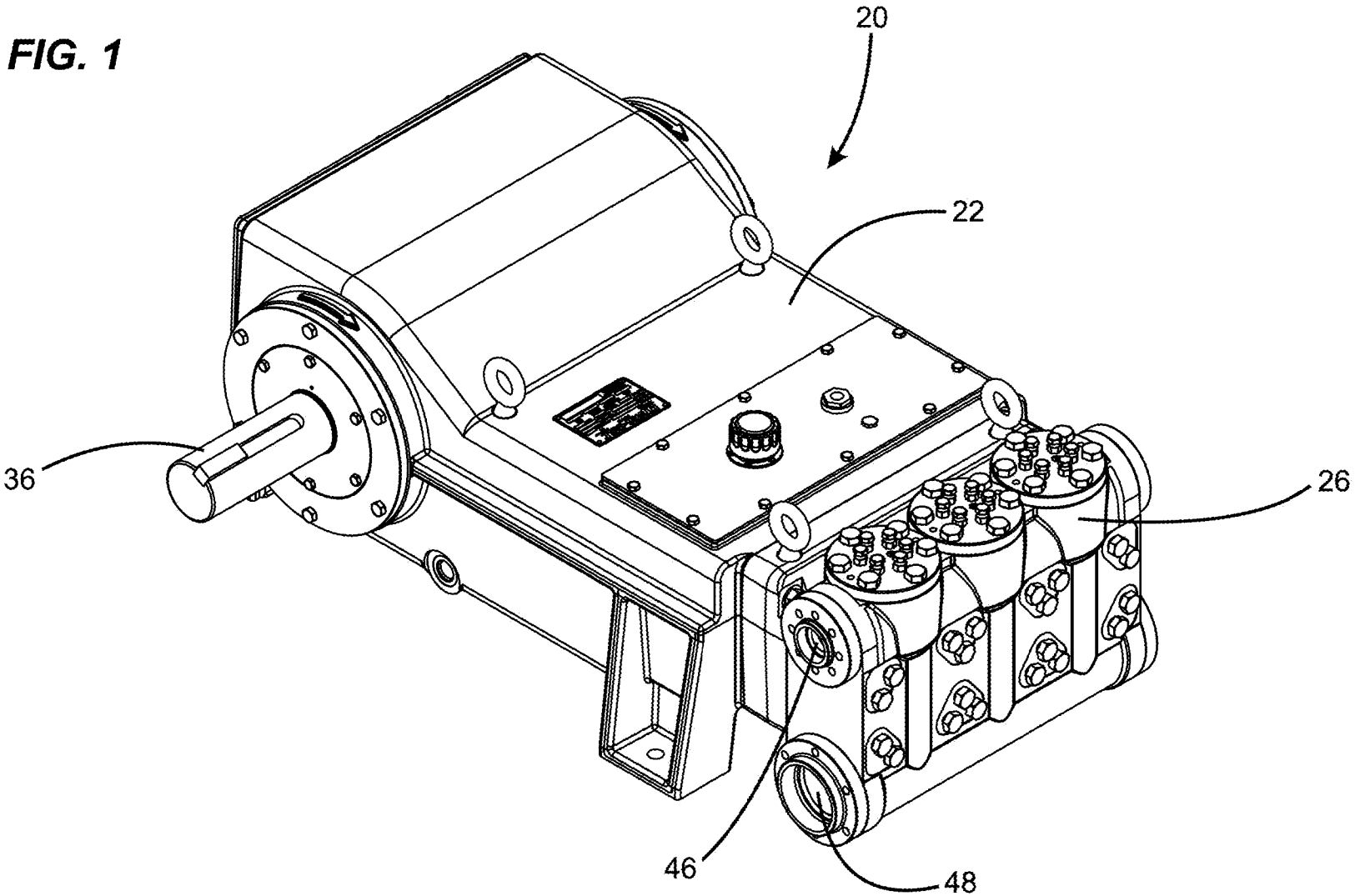
FIG. 1 is a perspective view of a first embodiment of a multi-cylinder plunger pump according to the principles of the present invention.
Figure 2:
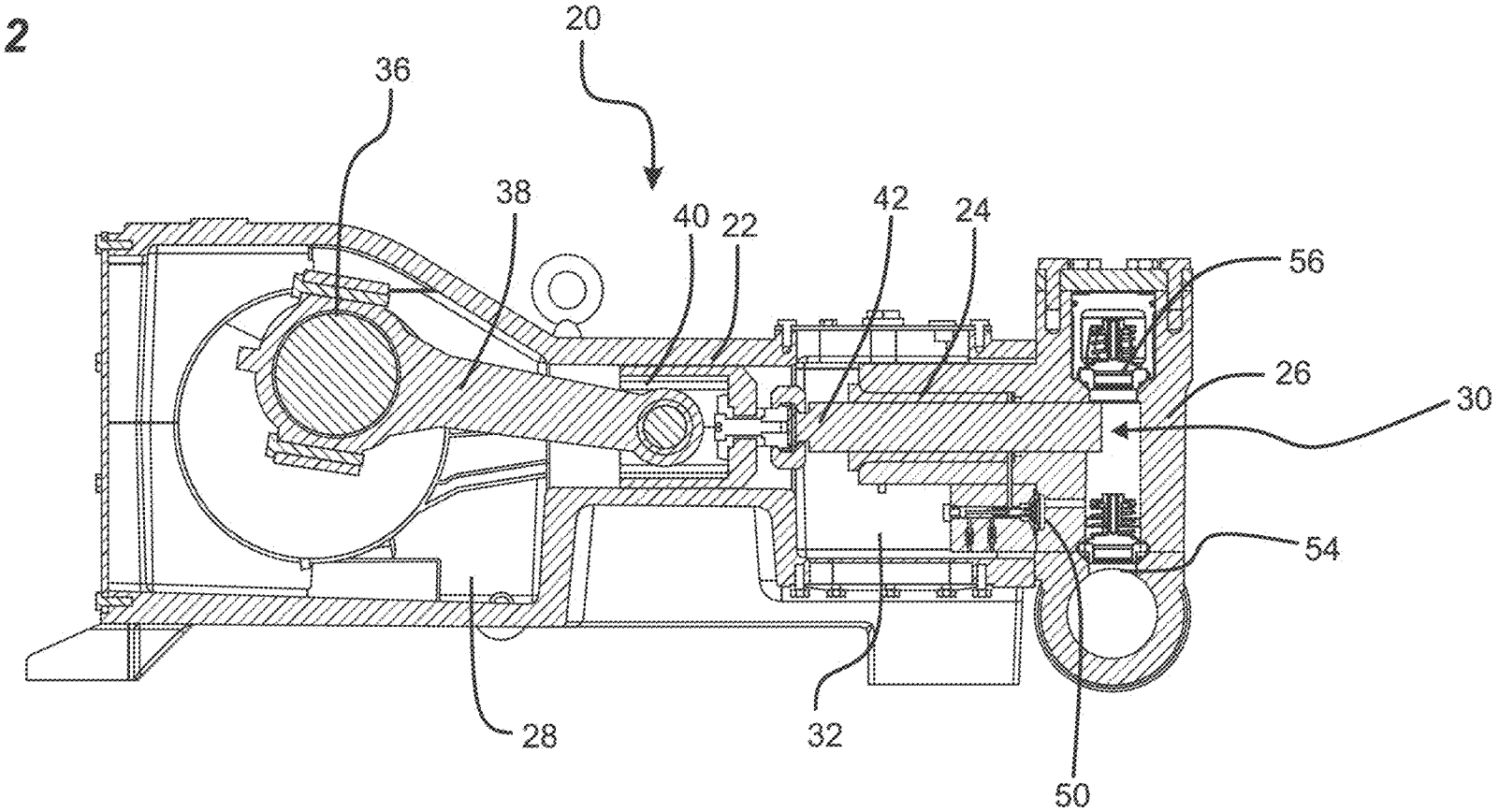
FIG. 2 is a side sectional view along an axis of one of the cylinders of the multi-cylinder plunger pump shown in FIG. 1.

Referring now to the drawings and in particular to FIGS. 1-2, there is shown a fluid pump (20). For multi-cylinder pumps, the pump (20) is driven by connection to a rotating crankshaft (36) mounted in a crankcase (22). A manifold (26) houses one or more check valves (54, 56). The pump (20) may include multiple pumping assemblies and associated components connected to the crankshaft (36).

Referring now to FIG. 2, a first embodiment of the pump (20) includes a plunger assembly, generally designated (30). The plunger assembly includes a plunger (42) displacing driven fluid. Hydraulic fluid (oil) is contained in a reservoir (28) and an oil sump (32). A sleeve (24) for the plunger (42) forms a cylindrical housing partially defining the oil sump (32). The crankshaft (36) includes a connecting rod (38) attached to a slider (40) in the crankcase (22). The slider (40) is connected to the plunger (42) that is actuated by the crankshaft (36) and reciprocates and drives the hydraulic fluid. It can be appreciated that in some embodiments, the crankshaft (36) may attach to multiple different pumping assemblies (20) within the same pump and may include offset portions along the shaft so that individual pumping assemblies (20) are synchronized to pump at various stages of the pumping stroke. As shown in FIG. 1, fluid being pumped is suctioned into the manifold (26) through a manifold inlet passage (48) into the pumping chamber (34) and discharged through a manifold discharge passage (46) by the plunger (42).

Figure 3:
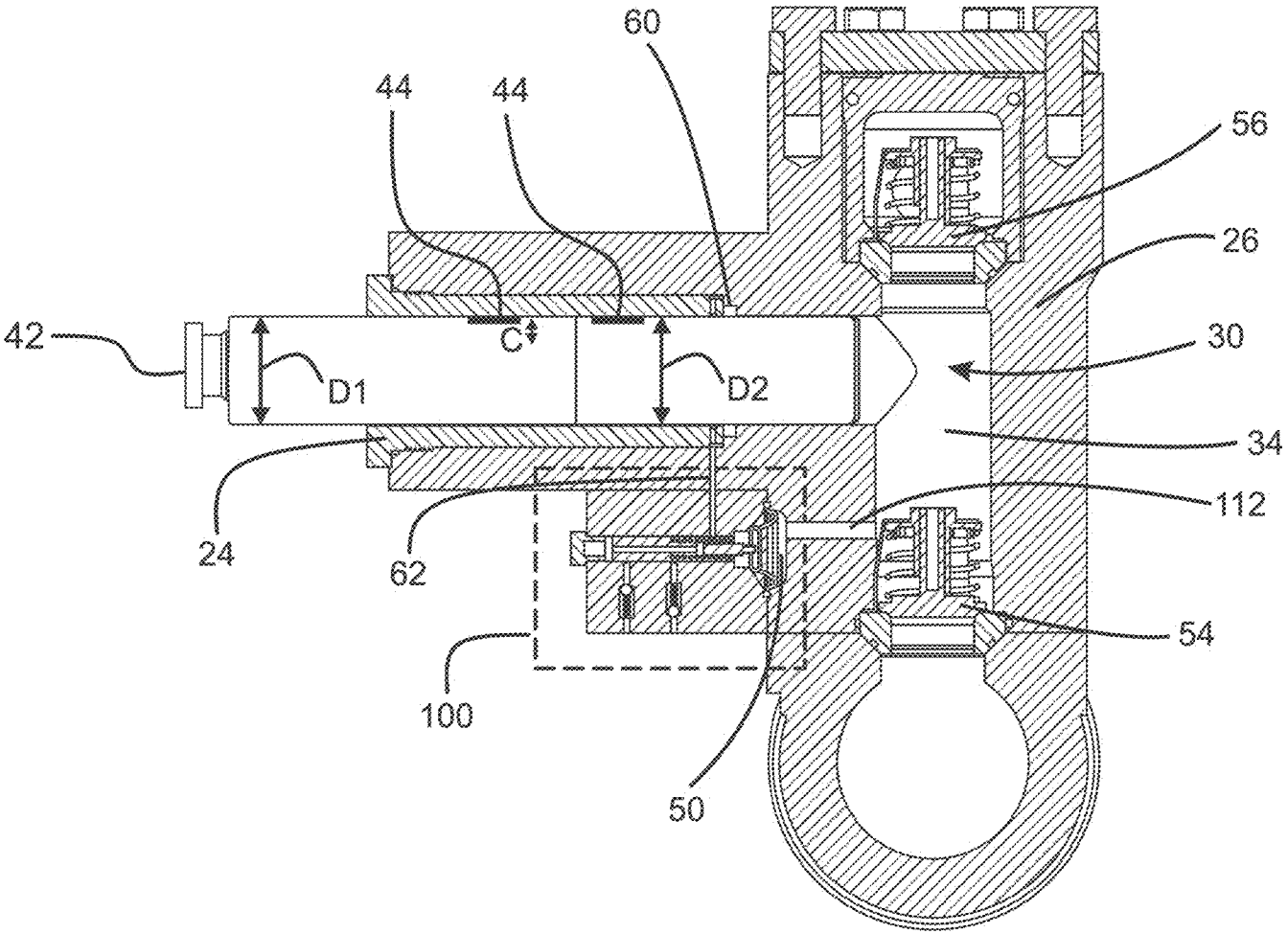
FIG. 3 is a sectional view of an embodiment of a pump without high pressure seals.
Figure 9:
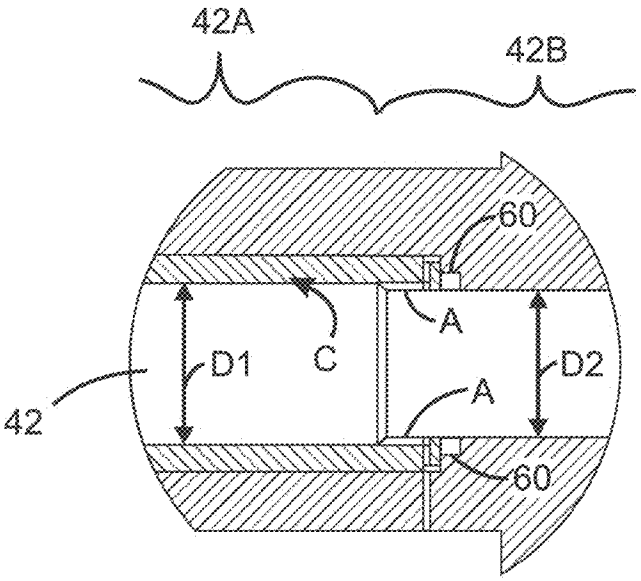
FIG. 9 is a detail side sectional view of the seals and step in diameter for the plunger shown in FIG. 8.
Figure 8:
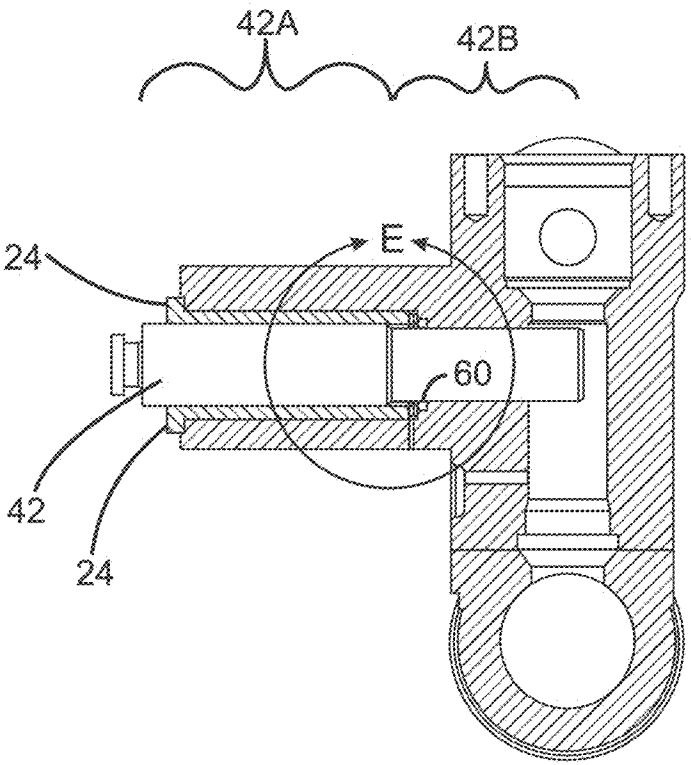
FIG. 8 is a side sectional view of the plunger and seals for the pump shown in FIG. 2.
Figure 10:
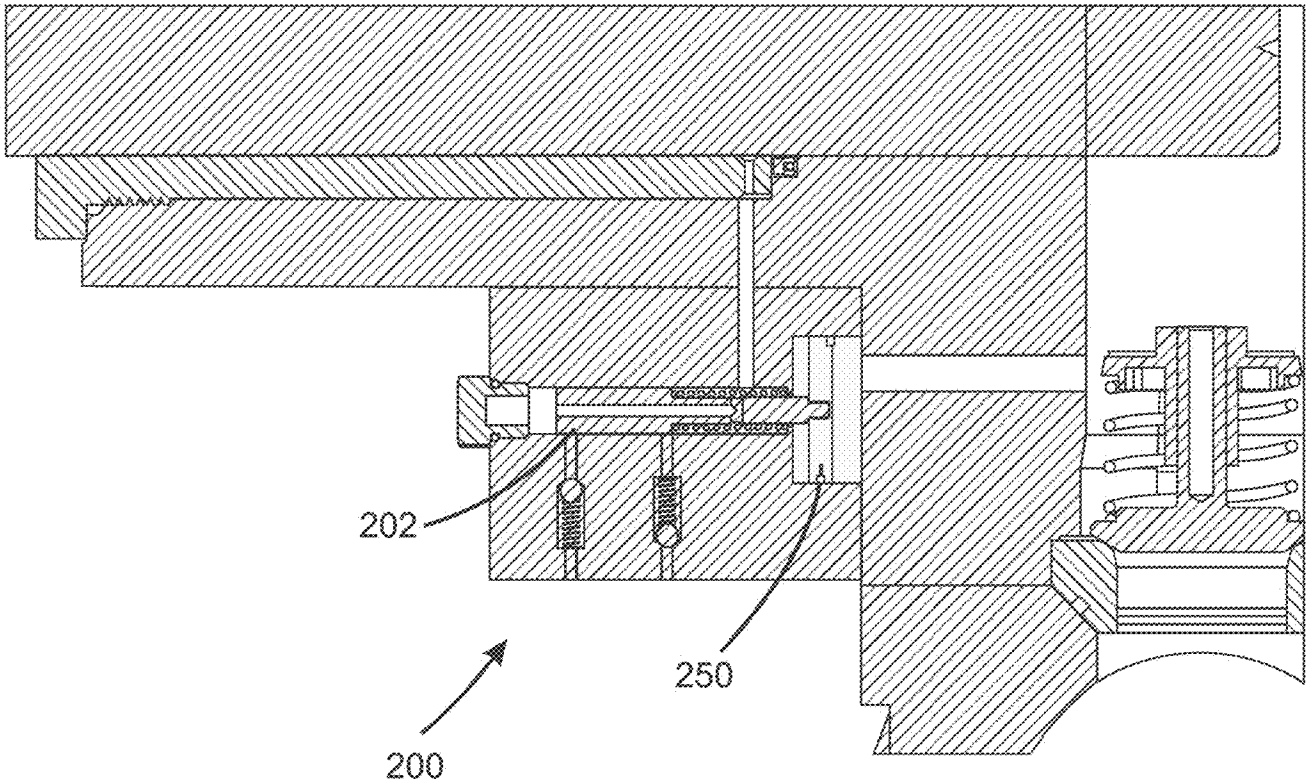
FIG. 10 is a side sectional view of a plunger pump according to the principles of the present invention and having second embodiment of a pressure balancing valve.

As shown in FIGS. 3, 8 and 9, the plunger (42) has a first portion (42A) with a first diameter (D1) that is made to fit closely to the inner cylinder of sleeve (24) with a very small clearance (C). The clearance (C) is sized to be sufficiently small that the clearance allows high pressure oil to only pass very slowly through the clearance. Typically, the clearance is about 0.001 inch measured radially. The plunger (42) has a second portion (42B) with a second diameter (D2) that is slightly smaller than the first with a clearance (C). A low pressure seal (60) is positioned so that the low pressure seal (60) contacts the second diameter (D2) for the full stroke of the plunger (42).

A fluid passage (62) connects with an annular space (A) between the second diameter (D2) of the plunger, and the seal (60) and radially outward from the second portion (42B) proximate a step up to the first portion (42A). Since the plunger (42) reciprocates, the annular space (A) changes in length during the stroke, causing a small displacement of the oil in that space. The volume of the displacement is defined by the area formed by the difference in diameter (D1) and diameter (D2) multiplied by the stroke of the plunger according to the formula:

$$V = \pi L\left((D1/2)^2 - (D2/2)^2\right)$$

Where: V is the volume
D1 is the outer diameter
D2 is the inner diameter
L is the length of the plunger stroke The diameters (D1, D2) are configured so that the oil displacement is slightly more than the maximum expected volume of oil that leaks past the clearance (C) during the pressure stroke of the pump. It can be appreciated that the plunger and cylinder may also be implemented for the piston pump (220) of FIG. 2.

The plunger (42) extends into the main pumping chamber (34). During the suction stroke the plunger (42) draws the pumped fluid, water for example, into chamber (34) through inlet check valve (54). During the pressure stroke the plunger (42) moves forward and displaces hydraulic fluid out of chamber (34) through the discharge check valve (56).

Figure 4:
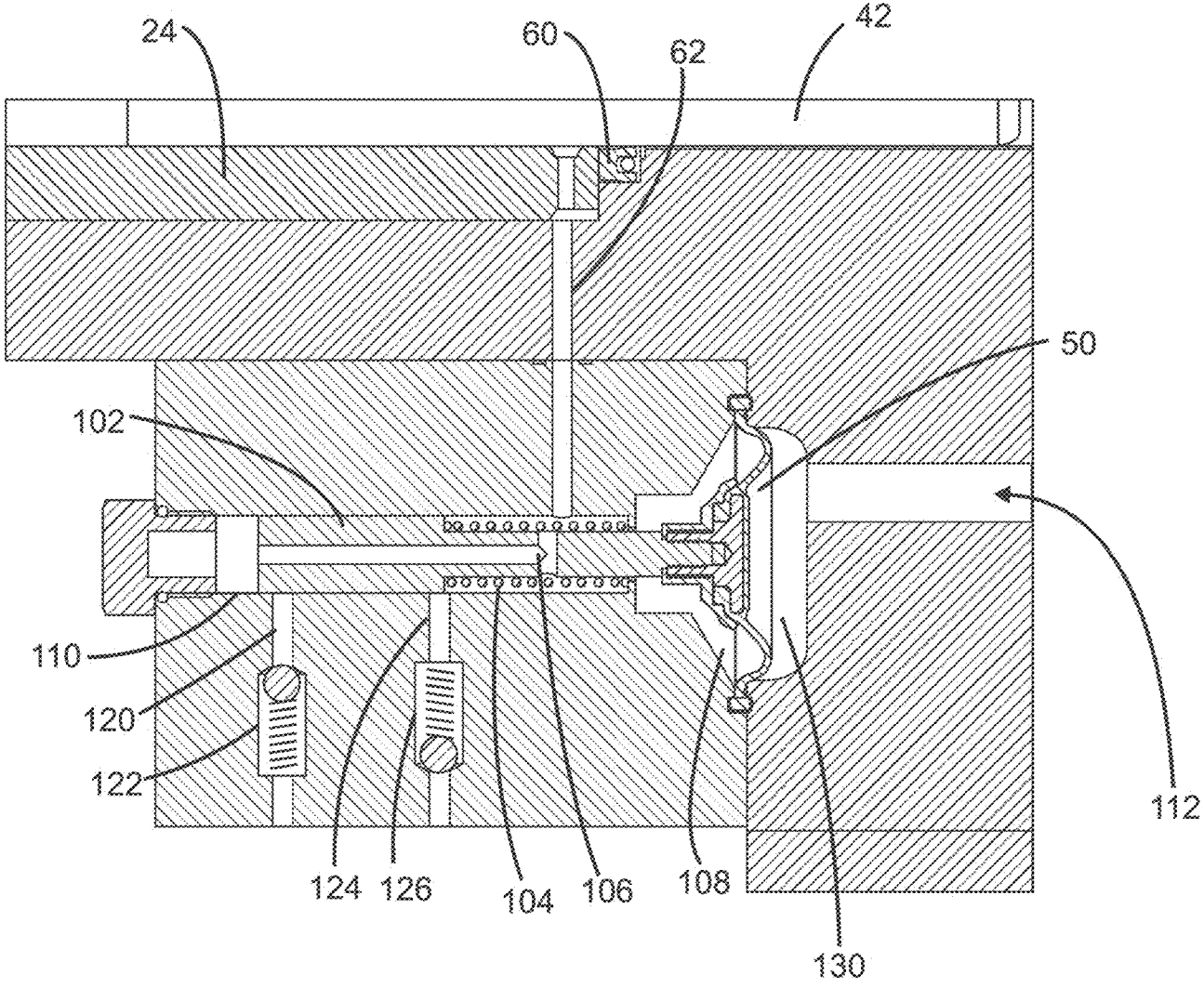
FIG. 4 is a sectional view of a pressure balancing valve for the pump shown in FIG. 1.

A pressure balancing valve (100) is connected to annular space (A) by the fluid passage (62). The valve (100) is also connected to the pumping chamber (34) by a passage (112). Referring to FIG. 4, a first embodiment of the pressure balancing valve (100) includes a diaphragm (50) which is connected to a valve spool (102). The spool (102) slides in a bore (110) that is connected to an oil chamber (108) at least partially formed by the back side of the diaphragm (50). The oil chamber (108) is filled with hydraulic fluid and is connected to both sides of the spool (102) by a passage (106) within the spool (102).

The spool (102) is positioned to cover and uncover two ports. The pressure balancing valve (100) includes an outlet port (120) connected to a pressure balancing outlet check valve (122) that allows hydraulic fluid to leave the oil chamber (108) and flow into the oil sump (32). The pressure balancing valve (100) includes an inlet port (124) connected to a pressure balancing inlet check valve (126) that allows hydraulic fluid to flow from the sump (32) into chamber (108).

A spring (104) is positioned to apply a biasing force on the spool (102), which in turn pulls on the diaphragm (50). The front of the diaphragm (50) faces a front chamber (130) that is connected to pumping chamber (34) by the passage (112). The pumping chamber (34), the front chamber (130) and the connecting passage (112) are always filled with the fluid being pumped, such as water.

In a second embodiment according to the present invention, a pressure balancing valve (200) includes a piston (250) driven connected to a spool (202) with a spring (104) between the spool (202) and the piston (250). This embodiment of the pressure balancing valve (200) is comparable to the embodiment (100) of FIG. 2, but the piston (250) is substituted for the diaphragm (50) as a fluid displacement device. It can be appreciated that other types of fluid displacement devices may also be used, such as a plunger.

Figure 5:
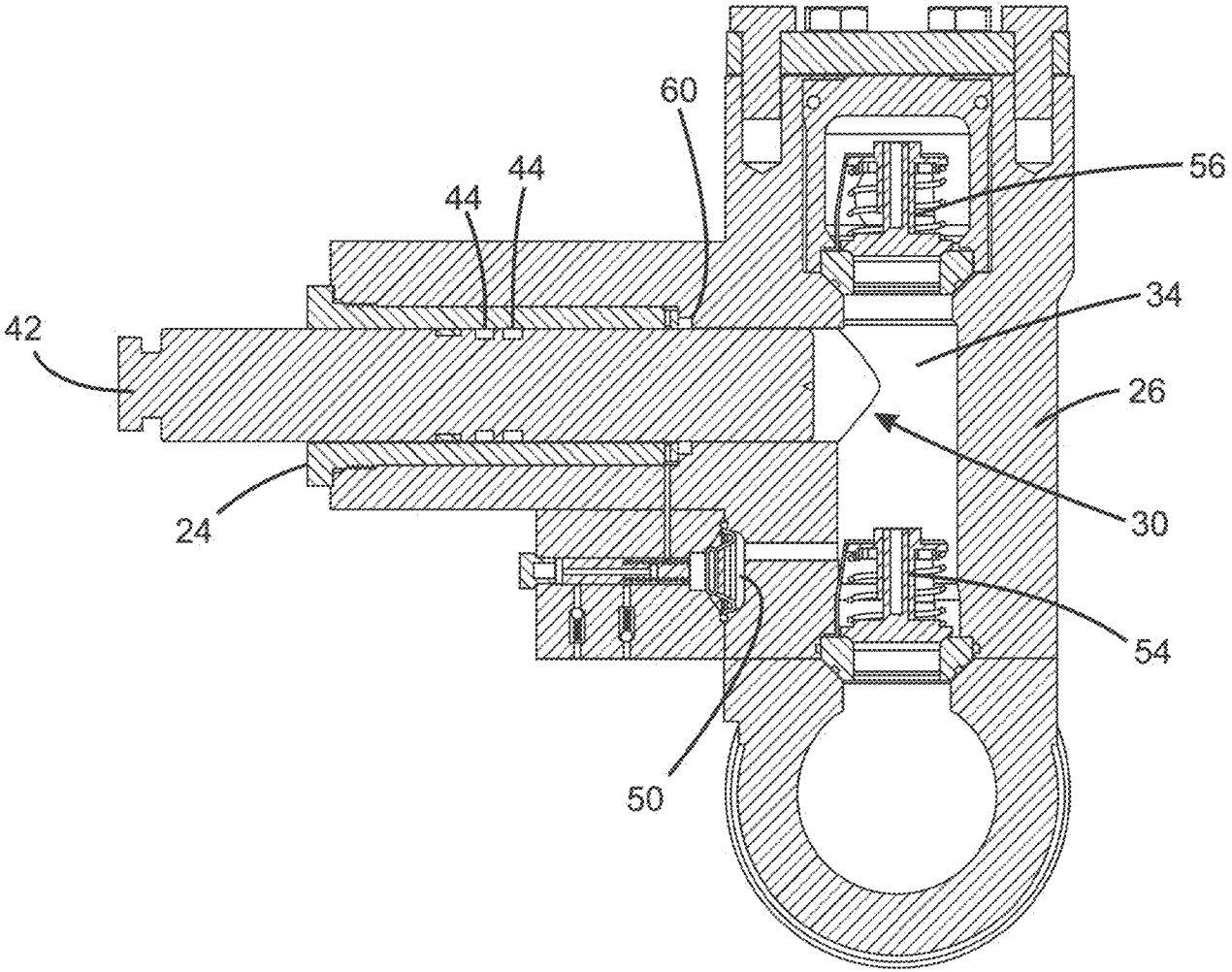
FIG. 5 is a sectional view of an embodiment of a pump with high pressure seals that contact only oil.
Figure 7:
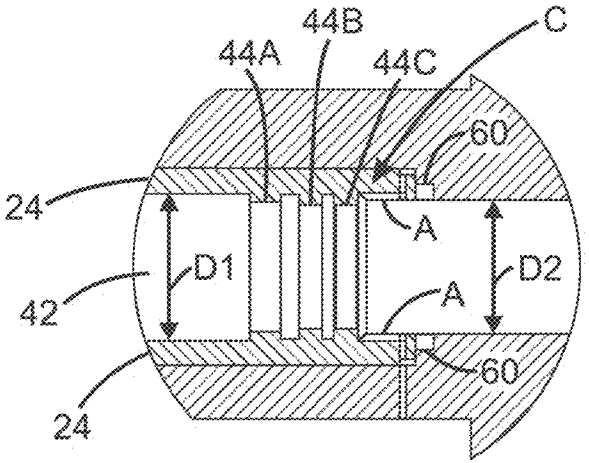
FIG. 7 is a detail side sectional view of the seals and step in diameter for the plunger shown in FIG. 6.
Figure 6:
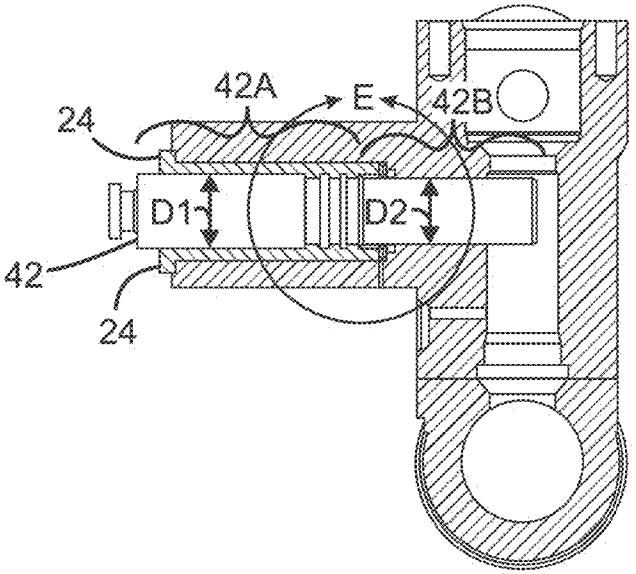
FIG. 6 is a side sectional view of the plunger and seals for the pump shown in FIG. 5.

Referring to FIGS. 5-7, there is shown another embodiment of the invention with the addition of high pressure seal rings (44A, 44B, 44C) that also provide a close fit. The configuration with high pressure seal rings (44) may be necessary in larger, high pressure pumps where the amount of hydraulic fluid that leaks past the close fit of the plunger (42) is too great. In this case metal piston rings are used as the sealing elements (44A, 44B, 44C). The metal piston rings achieve much higher life than an elastomeric seal, while also maintaining a small leak rate. Moreover, since the high pressure seal rings (44) are sealing only hydraulic fluid, the high pressure seal rings do not suffer the same wear as a conventional packing. However, it is appreciated that this type of seal may not be viable for sealing pumped fluid like water in a conventional plunger pump.

Operation

In operation, as the plunger (42) reciprocates, pumping chamber (34) cycles between high pressure during the pressure stroke, and low pressure during the suction stroke. Since the diaphragm (50) is able to move, the pressure of the hydraulic fluid in the chamber (108) also cycles between suction and discharge pressures.

The pressure balancing valve (100) maintains a volume of hydraulic fluid behind the diaphragm (50) so that the diaphragm (50) is always free to move and keep the hydraulic fluid pressure the same as the pumped fluid pressure. An objective of the present invention is to maintain hydraulic fluid pressure on the back side of the seal (60) that is very close to the pressure in the pumping chamber (34). In this way the seal (60) is not pressure energized and is not subject to high friction loads, thereby increasing the life of seals (60).

It has been found that it is also beneficial to have the oil pressure always slightly higher than the pumped fluid pressure. A pressure differential of about 5 psi provides a benefit of always having the hydraulic fluid escape past the seal (60) rather than the pumped fluid. In one example, during the suction stroke when the plunger (42) is retracting, the pumped fluid pressure might be 10 psi, so the hydraulic fluid pressure would be 15 psi. On the pressure stroke the pumped fluid pressure might rise to 10,000 psi, so the hydraulic fluid pressure would be 10,005 psi. Therefore, as the plunger (42) moves forward, a very small amount of hydraulic fluid is helped to escape past the valve by that slight pressure differential, thereby preventing the pumped fluid from ever getting past the seal (60). Moreover, it has been found that the differential pressure can be in the range of about 1 to 10 psi with similar benefits.

This small pressure differential is achieved by the force applied to the diaphragm by spring (104). The spring (104) is sized so the force when in the center position would be equal to the force exerted by the diaphragm (50) with a 5 psi differential across it. During each pressure stroke a small amount of oil leaks past the plunger clearance (C). Another advantage of the present invention is the ability of the valve (100) to replenish the hydraulic fluid in the oil chamber (108) as needed.

The length of the spool (102) allows the spool to cover the pressure balancing outlet port (120) and the pressure balancing inlet port (124) when the diaphragm (50) is in the center position. As hydraulic fluid is lost from the oil chamber (108), the diaphragm (50) moves back (to the left in FIG. 4) and the spool (102) will start to uncover the pressure balancing inlet port (124). During the suction stroke the pressure in the oil chamber (108) drops and hydraulic fluid is drawn in through the pressure balancing inlet check valve (126). In applications where the pump is pressure fed, the hydraulic fluid may not drop in pressure sufficient to draw in oil, so the diaphragm (50) will continue to move back until the diaphragm reaches its end of travel. At this point, the small displacement in space (A) draws hydraulic fluid in, dropping the pressure as needed to draw from the oil sump (32). If too much hydraulic fluid is drawn in, the diaphragm (50) will move forward, which closes the pressure balancing inlet port (124) and opens the pressure balancing outlet port (120). During the next pressure stroke, hydraulic fluid will discharge from the oil chamber (108) via the pressure balancing outlet check valve (122). As the pump (20) operates in steady state conditions, the pressure balancing valve (100) will reach an equilibrium position where the pressure balancing inlet port (124) is open just the amount needed to add hydraulic fluid to match the demand.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A pump comprising:

a cylindrical plunger chamber having an inward projecting radial seal;

a plunger moving with a reciprocating stroke within the cylindrical plunger chamber, the plunger having a first diameter, and a second diameter less than the first diameter, the radial seal engaging the plunger at the second diameter for an entire length of the stroke of the plunger;

a pressure balancing valve in fluid communication with a pumping chamber and a hydraulic oil chamber;

a fluid passage providing fluid communication between the plunger chamber and the pressure balancing valve, the fluid passage connecting to the plunger chamber at a position between the radial seal and the first diameter of the plunger;

wherein the pressure balancing valve comprises a spool sliding in a bore to cover and uncover a hydraulic fluid inlet port and a hydraulic fluid outlet port.

2. The pump according to claim 1, the plunger comprising:

a first portion with a first diameter, and a second portion with a second diameter smaller than the first diameter, the second portion being closer to a free end of the plunger;

a first radial seal engaging the first portion of the plunger;

a second radial seal engaging the second portion of the plunger;

a radial volume defined between the plunger chamber and the second portion of the plunger diameter and the second seal and the first portion of the plunger.

3. The pump according to claim 1, wherein the radial seal comprises one or more metal piston rings.

4. The pump according to claim 1, wherein:

in a first operating condition hydraulic fluid is drawn through a clearance space between a portion of the plunger and the cylindrical plunger chamber;

in a second operating condition the inlet port of the pressure balancing valve is open;

in a third operating condition the outlet port of the pressure balancing valve is open.

5. The pump according to claim 1, wherein the pressure balancing valve comprises a diaphragm having a pumping side, and an oil side with a hydraulic oil chamber partially formed by the oil side of the diaphragm.

6. The pump according to claim 5, further comprising a spring intermediate the spool and the diaphragm and applying a biasing force to the diaphragm.

7. The pump according to claim 6, wherein the spring is configured to exert a force of about 5 psi when the diaphragm is at a center position.

8. The pump according to claim 1, wherein the pressure balancing valve comprises a piston having a pumping side, and an oil side with a hydraulic oil chamber partially formed by the oil side of the piston.

9. A pressure balancing system for a pump having a hydraulic fluid sump, the pressure balancing system comprising:

a bore in fluid communication with an oil chamber;

a plunger;

a plunger chamber with a seal between the plunger and the plunger chamber;

a fluid passage from the plunger chamber to the bore;

a pressure balancing valve in fluid communication with the bore, the valve comprising:

an outlet port including an outlet check valve;

an inlet port including an inlet check valve;

a spool sliding in the bore to cover and uncover the inlet port and the outlet port;

a fluid displacement device having a pumping side, and an oil side; and a spring intermediate the spool and the fluid displacement device and applying a biasing force to the fluid displacement device, wherein the spring is configured to exert a force of about 5 psi when the fluid displacement device is at a center position.

10. The pressure balancing system according to claim 9, wherein the fluid displacement device comprises a diaphragm.

11. The pressure balancing system according to claim 9, wherein the fluid displacement device comprises a piston.

12. A method of operating a plunger pump, the plunger pump including:

a diaphragm having a first side and an opposite second side, the first side comprising a hydraulic fluid side;

a plunger reciprocating in a cylinder the plunger comprising a first portion with a first diameter, and a second portion with a second diameter smaller than the first diameter, the second portion being closer to a free end of the plunger;

a seal sealing against the second portion of the plunger;

a hydraulic fluid chamber between the seal and the first portion of the plunger;

an unrestricted first fluid path between the hydraulic fluid chamber and the first side of the diaphragm;

a second fluid path between the second side of the diaphragm and pumped fluid;

a radial clearance between the cylinder and the first portion of the plunger configured to allow hydraulic fluid to escape past the first portion of the plunger during a pressure stroke of the pump; the method comprising:

allowing hydraulic fluid to escape past the radial clearance;

supplying an amount of hydraulic fluid to replace the escaped hydraulic fluid;

wherein during a suction stroke, the pumped fluid drops in pressure from retraction of the plunger, allowing the diaphragm to freely float to drop pressure in the hydraulic fluid chamber to balance pressure across the seal; and wherein during the pressure stroke, the pumped fluid increases in pressure from extension of the plunger, pressing the diaphragm to increase the pressure in the hydraulic fluid chamber to balance pressure across the seal.

* * * * *